US006238047B1

(12) United States Patent
Suzuki et al.

(10) Patent No.: US 6,238,047 B1
(45) Date of Patent: May 29, 2001

(54) INK JET RECORDING MEDIUM FOR A PIGMENT INK

(75) Inventors: Shinichi Suzuki; Masaaki Saito; Hitoshi Kijimuta; Sumito Terayama, all of Yokohama (JP)

(73) Assignee: Asahi Glass Company, Tokyo (JP)

( * ) Notice: Subject to any disclaimer, the term of this patent is extended or adjusted under 35 U.S.C. 154(b) by 0 days.

(21) Appl. No.: 08/705,849

(22) Filed: Aug. 30, 1996

(30) Foreign Application Priority Data

Sep. 1, 1995 (JP) ..... 7-225513

(51) Int. Cl.[7] ..... B41J 2/01
(52) U.S. Cl. ..... 347/105; 347/101; 347/100
(58) Field of Search ..... 347/105, 101, 347/100, 102

(56) References Cited

U.S. PATENT DOCUMENTS

| | | | | |
|---|---|---|---|---|
| 4,542,059 | * | 9/1985 | Toganoh et al. | 428/141 |
| 4,725,849 | * | 2/1988 | Koike et al. | 347/100 |
| 5,172,133 | * | 12/1992 | Suga et al. | 347/106 |
| 5,180,624 | * | 1/1993 | Kojima et al. | 428/211 |
| 5,264,275 | | 11/1993 | Misuda et al. . | |
| 5,354,634 | * | 10/1994 | Misuda et al. | 430/18 |
| 5,443,727 | * | 8/1995 | Gagnon | 210/490 |
| 5,571,311 | * | 11/1996 | Belmont et al. | 106/20 R |
| 5,618,634 | * | 4/1997 | Hosoda et al. | 428/610 |
| 5,631,119 | * | 5/1997 | Shinozaki | 430/326 |
| 5,645,631 | * | 7/1997 | Koike et al. | 106/31.36 |
| 5,734,403 | * | 3/1998 | Suga et al. | 347/101 |
| 5,746,818 | * | 5/1998 | Yatake | 106/31.86 |
| 5,834,582 | * | 11/1998 | Sinclair et al. | 528/354 |
| 5,897,940 | * | 4/1999 | Malhotra | 428/212 |
| 5,955,185 | * | 9/1999 | Yoshino et al. | 347/105 |

FOREIGN PATENT DOCUMENTS

| | | | |
|---|---|---|---|
| 0 500 021 | | 8/1992 | (EP) . |
| 0 622 244 | | 11/1994 | (EP) . |
| 0 634 287 | | 1/1995 | (EP) . |
| 62-211195 | * | 9/1987 | (JP) . |

OTHER PUBLICATIONS

Asakura Shoten; *Encyclopedia of High Polymer*, Shohwa 46 (1971) Jun. 30; Publisher: Board of Encyclopedia of High Polymer; Editor: High Polymer Society of Japan.
Patent Abstracts of Japan, vol. 96, No. 001, JP 08 002090, Jan. 9, 1996.
Patent Abstracts of Japan, vol. 95, No. 009, JP 07 237348, Sep. 12, 1995.
Hack's Chemical Dictionary, p. 612, Oct. 1990.*

* cited by examiner

*Primary Examiner*—John Barlow
*Assistant Examiner*—Manish Shah
(74) *Attorney, Agent, or Firm*—Oblon, Spivak, McClelland, Maier & Neustadt, P.C.

(57) ABSTRACT

An ink jet recording medium for a pigment ink, which including a substrate, a porous layer of alumina hydrate having a thickness of from 1 to 200 μm, formed on the substrate, and a water-soluble resin layer having a thickness of from 0.01 to 50 μm, formed as an upper layer thereon.

16 Claims, No Drawings

INK JET RECORDING MEDIUM FOR A PIGMENT INK

The present invention relates to a recording medium and a recording method suitable for an ink jet recording system employing a pigment ink.

In recent years, reflecting wide spread use of electronic still cameras and computers, the hard copy technology to record images thereof on paper sheets or the like has been rapidly developed. The ultimate objective of such a hard copy technology is quality of a silver halide photography, and it is a theme for research and development how to bring the color reproduction, the color density, the resolution, the gloss, the weather resistance, etc. to the levels of the silver halide photography. As hard copy recording systems, various systems have been known including not only the system wherein a display indicating an image is directly photographed by silver halide photography, but also a sublimation type dye diffusion thermal transfer system, an ink jet system, and an electrostatic transfer system. An ink jet system printer has been widely used in recent years, since full coloring is easy, and the printing noise is low. The ink jet system is a system wherein ink droplets are ejected at a high speed from nozzles to a recording material, and the ink contains a large amount of a solvent. Therefore, the recording material for an ink jet printer is required to swiftly absorb the ink and have excellent color density. In such an ink jet recording system, it has been common to employ an ink of the type wherein a dye is dissolved in a solvent. However, it is also known to use an ink (a pigment ink) of the type wherein a pigment is dispersed in a solvent such as water. The ink jet image obtained by using such a pigment ink has a feature that discoloration or color change is little, and it is particularly excellent in the durability.

It is an object of the present invention to provide a recording medium and a recording method, whereby absorption of a pigment ink is excellent, the pigment in the ink is uniformly fixed to show excellent color development, and an ink jet image having a high color density can be obtained.

The present invention provides an ink jet recording medium for a pigment ink, which comprises a substrate, a porous layer of alumina hydrate having a thickness of from 1 to 200 $\mu$m, formed on the substrate, and a water-soluble resin layer having a thickness of from 0.01 to 50 $\mu$m, formed as an upper layer thereon.

Now, the present invention will be described in detail with reference to the preferred embodiments.

The substrate is not particularly limited, various types of substrates can be used. Specifically, plastics including a polyester resin such as polyethylene terephthalate, a polycarbonate resin, and a fluorine resin such as polytetrafluoroethylene (PTFE), and various papers, can suitably be used. Further, cloth, glass or metal may also be used. To such substrates, corona discharge treatment or various undercoatings may be applied for the purpose of improving the bond strength of the alumina hydrate layer. The shape of the substrate is not particularly limited, but it is common to employ a sheet or film having a thickness of from 0.01 to 10 mm.

When a transparent plastic film is used as the substrate, a transparent image may be obtained which can be used, for example, as transparencies for an OHP (overhead projector) sheet. When a paper or an opaque plastic film containing a white pigment is used as the substrate, an image comparable to a silver halide photography can be obtained.

In the present invention, the porous layer of alumina hydrate is considered to function as a layer for absorbing water which is the dispersion medium in the pigment ink. The alumina hydrate is preferably pseudo-boehmite, since it has excellent absorptivity. Here, pseudo-boehmite is an agglomate of alumina hydrate represented by a compositional formula of $Al_2O_3.nH_2O$ (n=1 to 1.5).

The porous layer of alumina hydrate preferably contains a binder. As the binder, an organic material such as starch or its modified product, polyvinyl alcohol or its modified product, a SBR latex, a NBR latex, carboxymethylcellulose, hydroxymethylcellulose or polyvinyl pyrrolidone, can be used. The binder is used preferably in an amount of from 5 to 50 wt % of the alumina hydrate. If the amount of the binder is less than 5 wt %, the strength of the alumina hydrate layer tends to be inadequate. On the other hand, if it exceeds 50 wt %, the ink absorptivity tends to be inadequate.

The porous layer of alumina hydrate preferably has pores having a pore radius of from 1 to 30 nm in a volume per unit weight of from 0.3 to 2.0 cc/g, whereby it shows adequate absorptivity, and the alumina hydrate layer is transparent. Here, if the substrate is transparent, it is possible to obtain a recording medium having high transparency. Even when the substrate is opaque, it is possible to obtain a recording medium which is capable of forming an image of high quality and high color density without impairing the texture of the substrate. More preferably, the alumina hydrate layer has pores having a pore radius of from 3 to 10 nm in a volume per unit weight of from 0.3 to 1.0 cc/g. The pore radius distribution is measured by a nitrogen absorption/desorption method.

The water-soluble resin layer formed on the alumina hydrate layer is required to be made of a material which swells upon absorption of the dispersion medium or solvent in the ink. It is believed that the ink fixing property is achieved by the swelling at the time of recording, followed by drying. It is also believed that the ink drying speed at the outermost surface of the sheet is controlled within a proper range by virtue of the water-soluble resin layer, and the ink surface after drying will be flat and smooth, whereby the image quality is improved.

In the present invention, as the water-soluble resin layer, a water-soluble polymer material is preferably employed. The water-soluble polymer material preferably has a physical property whereby it can form a film uniformly without undergoing agglomeration or gelation. It may, for example, be starch, oxidized starch, a modified starch such as a grafted, etherified or esterified starch, a cellulose derivative such as methylcellulose, carboxymethyl cellulose or hydroxyethyl cellulose, a modified cellulose such as a grafted cellulose, a protein such as agarose, gelatin, casein or soybean protein, partially or completely saponified polyvinyl alcohol, a modified polyvinyl alcohol such as a carboxylated or olefin-modified polyvinyl alcohol, a polymer such as polyvinyl pyrrolidone, polyvinyl acetal, sodium polyarginate, a hydrophilic urethane resin, polyacrylic acid, polyacryloamide, polyvinylmethylether or polyethylene imide, acrylic acid, a vinyl alcohol copolymer, or a mixture thereof.

The water-soluble polymer material is preferably one having a viscosity of from 0.01 to 10,000 centipoise (cp) at 25° C. in its aqueous solution having a concentration of 1 wt %. If the viscosity exceeds 10,000 cp, it tends to be difficult to form a uniform film, since the alumina hydrate layer is porous. More preferably, the viscosity is within a range of from 0.1 to 1,000 cp.

The water-soluble polymer preferably has a solubility parameter (SP value) close to water. The SP value of the water-soluble resin to be used in the present invention is preferably from 8 to 23 cal/cm$^3$ at 25° C. The above water-soluble resin layer may be a non-porous film or a porous film. In the case of the non-porous film, the water-soluble resin is coated in the form of an aqueous solution. In the case of the porous film, it can be coated in the form of an emulsion of the water-soluble resin, whereby the drying property of ink absorbed in the medium will be excellent. When the water-soluble resin layer is a porous layer, the layer preferably has pores having a pore radius of from 1 to 30 nm in a volume per unit weight of from 0.3 to 2.0 cc/g.

The water-soluble resin layer is formed as a porous layer, and it may contain silica or alumina particles to improve the quick drying property of ink. Silica or alumina may be mixed in the form of a silica sol or an alumina sol at the time of forming the water-soluble resin layer. In such a case, the amount of silica or alumina in the water-soluble resin layer is preferably from 5 to 50 wt %, more preferably from 10 to 30 wt %, based on the water-soluble resin.

The silica or alumina particles in the sol for forming the porous layer preferably has an average particle radius of from 1 to 700 nm, more preferably from 10 to 500 nm, at the time of forming the layer.

Further, to impart printer sheet feedability to the recording medium of a sheet shape, large size particles having a particle size larger than the thickness of the water-soluble resin layer, may be incorporated to the layer. In such a case, these particles partially protrude from the water-soluble resin layer to provide a surface roughness.

Such large size particles may have any shape, but a spherical shape is particularly preferred, since the sliding property is thereby improved. Further, particles having an average particle diameter of from 0.02 to 100 μm are preferred. If the average particle diameter is less than 0.02 μm, the surface roughness tends to be inadequate, whereby no adequate sliding property will be imparted. On the other hand, if it exceeds 100 μm, the printing quality is likely to be inadequate. More preferably, the average particle diameter is within a range of from 0.5 to 30 μm.

The material for the large size particles is not particularly limited. However, silica or various resins may, for example, be employed. The resins include, for example, polystyrene and polymethylmethacrylate (PMMA). The shape of particles is preferably a spherical shape from the viewpoint of e.g. excellent dispersibility. However, particles of non-fixed shape may also be used.

The content of such large size particles is preferably from 0.001 to 5 wt % based on the water-soluble resin. If the content is less than 0.001 wt % based on the water-soluble resin, no adequate sliding property will be obtained. Further, if the content exceeds 5 wt % based on the water-soluble resin, the quality of the image tends to deteriorate. A more preferred range is from 0.01 to 2 wt %.

As a method for forming an alumina hydrate layer on the substrate, it is preferred to employ a method wherein a binder and a dispersion medium, preferably water, are added to alumina hydrate to obtain a sol-state coating liquid, which is then coated on the substrate, followed by drying. It is preferred to employ an alumina sol as the starting material for the alumina hydrate, since it is thereby possible to form an alumina hydrate layer excellent in the transparency. As the coating means, it is preferred to employ, for example, a die coater, a roll coater, an air knife coater, a blade coater, a rod boater, a bar coater or a comma coater. The solvent for the coating liquid may be either a water type or a non-water type.

The thickness of the alumina hydrate layer is suitably selected depending upon the specification of e.g. a printer. It is usually from 1 to 200 μm. If the thickness of the alumina hydrate layer is less than 1 μm, no adequate ink absorptivity tends to be obtained, and if it exceeds 200 μm, the transparency of the alumina hydrate layer tends to be impaired, or the strength of the layer tends to be low. The thickness of the alumina hydrate layer is more preferably from 5 to 100 μm.

As a method for forming the water-soluble resin layer on the alumina hydrate layer, it is preferred to employ a method wherein a water-soluble resin and, if necessary, a silica sol or an alumina sol, are dissolved in water or dispersed in water in a latex-state, and the solution or dispersion thereby obtained is coated on the alumina hydrate layer, followed by drying. As the coating means, like in the case of forming the alumina hydrate layer, a die coater, a roll coater, an air knife coater, a blade coater, a rod coater, a bar coater or a comma coater, may, for example, be employed.

The thickness of the water-soluble resin is suitably selected depending upon the specification of e.g. a printer and is preferably smaller than the alumina hydrate layer. Usually, it is preferred to employ a thickness of from 0.01 to 50 μm. If the thickness of the water-soluble resin layer is less than 0.01 μm, the ink fixing property may not be adequately improved. On the other hand, if it exceeds 50 μm, the ink absorptivity tends to be poor. The thickness is more preferably from 0.02 to 10 μm.

When ink jet printing is carried out on the recording medium of the present invention by means of a pigment ink, the pigment ink to be used is not particularly limited, but the pigment is used as dispersed in water. The content of pigment in the ink is preferably from 0.5 to 20 wt %, more preferably from 2 to 12 wt %, based on the entire ink. The content of water in the ink is usually from 10 to 93 wt %, preferably from 25 to 87 wt %. The pigment ink may contain a pH controlling agent, an antiseptic, etc., as the ease requires.

Referring to the pigment for the pigment ink, as carbon black to be used for black ink, it is preferred to employ carbon black produced by a farnest method or a channel method, of which the primary particle size is from 15 to 40 nm, the specific surface area is from 50 to 300 m$^2$/g as measured by BET method, the DBP oil absorption is from 40 to 150 ml/100 g, the volatile content is from 0.5 to 12%, and the pH value is from 2 to 9.

The pigment to be used for black ink may, for example, be C.I. Pigment Black 1, 7 or 11.

The pigment to be used for yellow ink may, for example, be C.I. Pigment Yellow 1, 5, 12, 13, 14, 16, 17, 24, 42, 53, 73, 74, 75, 83, 95, 98, 100, 108, 109, 110, 180 or 182.

The pigment to be used for magenta ink, may, for example, be C.I. Pigment Red 1, 3, 4, 5, 7, 12, 17, 22, 31, 48, 49, 53, 63, 64, 88, 101, 112, 122, 123, 168, 184, or 202.

The pigment to be used for cyan ink, may, for example, C.I. Pigment Blue 1, 2, 3, 15, 16, 22, 27, 28, 29, 56, 60, or 63.

The above exemplified types of inks are useful for the fundamental four colors. To obtain other colors, pigments may be used alone or in combination.

Now, the present invention will be described in further detail with reference to Examples. However, it should be understood that the present invention is by no means restricted to such specific Examples.

EXAMPLE 1

100 g of an alumina sol having a solid content of 18 wt % prepared by hydrolysis and peptization of an alumina alkoxide and 32 g of an aqueous solution containing 6.2 wt % of polyvinyl alcohol were mixed to obtain a coating liquid. This coating liquid was coated on a polyethylene terephthalate film (thickness; 100 μm, white color) by means of a bar coater so that the coated amount after drying would be 26 g/m$^2$, followed by drying to form a pseudo-boehmite layer. The layer had pores having a pore radius of from 1 to 30 nm in a volume per unit weight of 0.8 cc/g. Further, an aqueous solution containing 10 wt % of polyvinyl pyrrolidone (PVP K 15, manufactured by Gokyo Sangyo K.K., molecular weight: 10,000, viscosity: 3 cp) was coated on the above pseudo-boehmite layer at 80° C., followed by drying and heat treatment at 140° C. to obtain a recording sheet with a polyvinyl pyrrolidone layer having a thickness of 0.2 μm on its surface.

EXAMPLE 2

A recording sheet was prepared in the same manner as in Example 1 except that on the pseudo-boehmite layer in Example 1, a coating liquid prepared by mixing soluble starch (viscosity: 5 cp) and a silica sol (SI-45P, tradename, manufactured by Shokubai Kasei Kogyo K.K.) so that the solid content weight ratio became 5:1, was coated and dried so that the thickness after the heat treatment would be 0.2 μm.

EXAMPLE 3

A recording sheet was prepared in the same manner as in Example 1 except that on the pseudo-boehmite layer in Example 1, a coating liquid prepared by mixing 0.5 wt %, based on the resin solid content, of spherical particulate polystyrene having a particle diameter of 10 μm (Micro Pearl SP-200, tradename, manufactured by Sekisui Fine Chemical K.K.) with a liquid comprising polyvinyl pyrrolidone (PVP K-30, manufactured by Gokyo Sangyo K.K., molecular weight: 40,000, viscosity: 3 cp), was coated and dried so that the thickness after the thermal treatment would be 0.5 μm.

EXAMPLE 4

A recording sheet was prepared in the same manner as in Example 1 except that on the pseudo-boehmite layer in Example 1, a coating liquid prepared by mixing polyvinyl pyrrolidone (PVP K-90, manufactured by Gokyo Sangyo K.K., molecular weight: 1,200,000, viscosity: 5 cp) and an alumina sol prepared by hydrolysis and peptization of an aluminum alkoxide so that the solid content weight ratio would be 4:1, was coated and dried so that the thickness after the thermal treatment would be 0.5 μm.

EXAMPLE 5

A recording sheet was prepared in the same manner as in Example 1 except that a coating liquid comprising acrylic acid—vinyl alcohol copolymer (SP-510, manufactured by Sumitomo Chemical Industries Co., Ltd. viscosity: 1500 cp), was coated and dried so that the thickness after heat treatment became 0.2 μm.

EXAMPLE 6

A recording sheet was prepared in the same manner as in Example 1 except that on the pseudo-boehmite-layer in Example 1, a coating liquid prepared by mixing 0.5 wt %, based on the resin solid content, of spherical PMMA particles having a particle diameter of 20 μm (MBX 20, tradename, manufactured by Sekisui Fine Chemical K.K.) with a liquid comprising acrylic acid—a vinyl alcohol copolymer (SP-520, manufactured by Sumitomo Chemical Industries Co., Ltd. viscosity: 2500 cp), was coated and dried so that the thickness after the heat treatment would be 0.2 μm.

EXAMPLE 7 (Comparative Example)

A recording sheet was prepared in the same manner as in Example 1 except that no polyvinyl pyrrolidone layer was formed.

Printing evaluation

With respect to the recording sheets of Examples 1 to 7, printing evaluation was carried out using black ink 51629 A of an ink jet printer (Desk Writer 660C, manufactured by Hewlett Packard).

Ink fixing property: The ink fixing property was evaluated in such a manner that the black ink was printed by a hundred percent solid printing and dried at room temperature for 5 minutes, whereupon the printed part was rubbed with a finger, whereby a case where no ink was detached, is indicated by symbol ○ and a case where the ink was detached, is indicated by symbol X.

Beading: The black ink was printed by a hundred percent solid printing, whereupon beading was visually evaluated. Symbol ○ indicates that no beading was observed, and symbol X indicates that beading was observed.

Sheet feeding property; Three recording sheets of A4 size were put one on another in a paper supplying cassette for an ink jet printer, and subjected to continuous printing. Symbol ◎ indicates that all sheets were properly automatically supplied one after another, symbol ○ indicates that the supply was slightly poor, but continuous supply was possible, and symbol x indicates that the sheets were supplied to the printer in the stacked state, and supply of the sheets was poor.

TABLE 1

| | Ink fixing property | Beading | Sheet feeding property |
|---|---|---|---|
| Example 1 | ○ | ○ | ○ |
| Example 2 | ○ | ○ | ○ |
| Example 3 | ○ | ○ | ◎ |
| Example 4 | ○ | ○ | ◎ |
| Example 5 | ○ | ○ | ○ |
| Example 6 | ○ | ○ | ◎ |
| Example 7 (Comparative Example) | X | ○ | ○ |

With the recording sheets of Examples 1 to 6, the ink fixing property was excellent, clear images were obtained, and the print quality was excellent. In Example 7, the fixing property of the pigment ink was poor, and when rubbed, the pigment was detached.

The recording sheet of the present invention exhibits high absorptivity and excellent fixing property with respect to a pigment ink and presents an excellent color developing property. It is particularly suitable as a recording medium for an ink jet printer.

What is claimed is:

1. An ink jet recording method, comprising the step of ink-jetting a pigment ink dispersed in water to a water-soluble resin layer of a recording medium which comprises a substrate, a porous layer of alumina hydrate having a thickness of from 1 to 200 μm formed on the substrate, and said water-soluble resin layer formed as an upper layer thereon, wherein said water-soluble resin layer is a porous layer having a thickness of 0.01–50 μm, a pore radius of 1–30 nm and a pore volume per unit weight of 0.3–2.0 cc/g.

2. The ink jet recording method according to claim 1, wherein the pigment ink dispersed in water, contains a pigment in an amount of from 0.5 to 20 wt % based on the entire pigment ink.

3. The ink jet recording method according to claim 1, wherein the pigment ink dispersed in water contains carbon black as the pigment.

4. The ink jet recording method according to claim 1, wherein the water soluble resin layer comprises a water-soluble polymer having a solubility parameter of 8–23 cal/cm$^3$ at 25° C.

5. The ink jet recording method according to claim 1, wherein the water soluble resin layer comprises a water soluble polymer material that, when present in a 1 wt % aqueous solution, has a viscosity of 0.01–10,000 cp at 25° C.

6. The ink jet recording method according to claim 1, wherein the water soluble resin layer comprises silica or alumina particles in an amount of 5–50%, based on the water soluble resin.

7. The ink jet recording method according to claim 1, wherein the water soluble resin layer is a non-porous film.

8. The ink jet recording method according to claim 1, wherein the water soluble resin layer comprises particles having an average particle diameter of 0.02–100 μm in an amount of 0.001–5 wt % based on the water soluble resin.

9. The ink jet recording method according to claim 1, wherein the water soluble resin layer comprises a water-soluble polymer selected from the group consisting of starch, oxidized starch, modified starch, grafted starch, etherified starch, esterified starch, cellulose derivative, methylcellulose, carboxymethyl cellulose, hydroxyethyl cellulose, modified cellulose, grafted cellulose, protein, agarose, gelatin, casein, soybean protein, partially saponified polyvinyl alcohol, completely saponified polyvinyl alcohol, modified polyvinyl alcohol, carboxylated polyvinyl alcohol, olefin-modified polyvinyl alcohol, polyvinyl pyrrolidone, polyvinyl acetal, sodium polyarginate, hydrophilic urethane resin, polyacrylic acid, polyacryloamide, polyvinylmethylether imide, polyethylene imide, acrylic acid and vinyl alcohol copolymer and mixtures thereof.

10. The ink jet recording method according to claim 1, wherein the substrate comprises a material selected from the group consisting of plastic, polyester resin, polyethylene terephthalate, polycarbonate resin, fluorine resin, polytetrafluoroethylene (PTFE), paper, cloth, glass and metal.

11. The ink jet recording method according to claim 1, wherein the substrate is a transparent plastic film.

12. The ink jet recording method according to claim 1, wherein the substrate is a paper or an opaque plastic film.

13. The ink jet recording method according to claim 1, wherein the porous alumina hydrate layer comprises a binder selected from the group consisting of starch, modified starch, polyvinyl alcohol, modified polyvinyl alcohol, SBR latex, NBR latex, carboxymethylcellulose, hydroxymethylcellulose and polyvinyl pyrrolidone.

14. The ink jet recording method according to claim 1, wherein the porous alumina hydrate layer comprises a binder in an amount of 5–50 wt %, based on the alumina hydrate.

15. The ink jet recording method according to claim 1, wherein the porous alumina hydrate layer comprises pores having a pore radius of 1–30 nm in a volume per unit weight of 0.3–2.0 cc/g.

16. The ink jet recording method according to claim 1, wherein the pigment ink comprises pigment particles having a primary particle size of 15–40 nm.

* * * * *